US012601093B2

(12) United States Patent
Gentilcore et al.

(10) Patent No.: US 12,601,093 B2
(45) Date of Patent: Apr. 14, 2026

(54) NONWOVEN FABRIC; POUCHED PRODUCT AND RELATED METHODS

(71) Applicant: Nonwovenn Ltd, Bridgwater (GB)

(72) Inventors: Giovanni Gentilcore, Bridgwater (GB); David Hill, Bridgwater (GB); Adrian Bisson, Bridgwater (GB)

(73) Assignee: Nonwovenn Ltd, Bridgwater (GB)

( * ) Notice: Subject to any disclaimer, the term of this patent is extended or adjusted under 35 U.S.C. 154(b) by 66 days.

(21) Appl. No.: 18/263,839

(22) PCT Filed: Feb. 4, 2022

(86) PCT No.: PCT/EP2022/052786

§ 371 (c)(1),
(2) Date: Aug. 1, 2023

(87) PCT Pub. No.: WO2022/167621

PCT Pub. Date: Aug. 11, 2022

(65) Prior Publication Data

US 2024/0117539 A1 Apr. 11, 2024

(30) Foreign Application Priority Data

Feb. 5, 2021 (GB) ..... 2101624
Jun. 4, 2021 (GB) ..... 2108044

(51) Int. Cl.

| | |
|---|---|
| ***D04H 1/587*** | (2012.01) |
| ***D04H 1/64*** | (2012.01) |
| ***D04H 1/645*** | (2012.01) |
| ***D04H 1/72*** | (2012.01) |

(52) U.S. Cl.
CPC ..... *D04H 1/587* (2013.01); *D04H 1/641* (2013.01); *D04H 1/645* (2013.01); *D04H 1/72* (2013.01); *D10B 2505/10* (2013.01)

(58) Field of Classification Search
USPC ..... 428/34.3
See application file for complete search history.

(56) References Cited

U.S. PATENT DOCUMENTS

| | | | |
|---|---|---|---|
| 12,178,905 | B2 | 12/2024 | Johnson et al. |
| 2002/0032253 | A1 | 3/2002 | Lorenz et al. |

(Continued)

FOREIGN PATENT DOCUMENTS

| | | | |
|---|---|---|---|
| CA | 2922928 | A1 | 9/2016 |
| CN | 1407926 | A | 4/2003 |

(Continued)

OTHER PUBLICATIONS

Third Part Observation Pursuant to Rule 114(2) EPC dated Jul. 3, 2024, Internet Search "How to measure Hansen Parameters", from corresponding European Application No. 22705381.6.

(Continued)

*Primary Examiner* — Maria V Ewald
(74) *Attorney, Agent, or Firm* — Troutman Pepper Locke LLP

(57) ABSTRACT

The present invention provides a nonwoven fabric comprising a non-fibrous binder having certain solubility characteristics. It also provides a pouched product, the fabric and contents of which have certain solubility characteristics. Related methods are also disclosed.

21 Claims, 1 Drawing Sheet

(56) References Cited

U.S. PATENT DOCUMENTS

| | | | | |
|---|---|---|---|---|
| 2002/0046800 | A1* | 4/2002 | Barker | D04H 1/495 156/148 |
| 2008/0295852 | A1 | 12/2008 | Riepert et al. | |
| 2012/0031416 | A1 | 2/2012 | Atchley et al. | |
| 2012/0103353 | A1 | 5/2012 | Sebastian et al. | |
| 2013/0149254 | A1 | 6/2013 | Gedevanishvili et al. | |
| 2013/0157537 | A1* | 6/2013 | Jackson | D04H 1/492 428/292.1 |
| 2014/0023807 | A1* | 1/2014 | Martins | D04H 1/26 428/156 |
| 2014/0026912 | A1 | 1/2014 | Rushforth et al. | |
| 2014/0242309 | A1* | 8/2014 | Foss | D04H 1/435 442/337 |
| 2014/0261480 | A1 | 9/2014 | Carroll et al. | |
| 2016/0000140 | A1 | 1/2016 | Sebastian et al. | |
| 2016/0040337 | A1 | 2/2016 | Dutkiewicz et al. | |
| 2016/0073689 | A1 | 3/2016 | Sebastian et al. | |
| 2018/0153211 | A1 | 6/2018 | Persson | |
| 2020/0297024 | A1 | 9/2020 | Bodin | |
| 2021/0107263 | A1* | 4/2021 | Bartolucci | B65D 75/30 |
| 2021/0170031 | A1 | 6/2021 | Gerardi et al. | |

FOREIGN PATENT DOCUMENTS

| | | | |
|---|---|---|---|
| CN | 101821441 | A | 9/2010 |
| CN | 105887330 | A | 8/2016 |
| CN | 106460271 | A | 2/2017 |
| DE | 202015102564 | U1 | 8/2015 |
| EP | 1031653 | A1 | 8/2000 |
| EP | 1000188 | B1 | 10/2002 |
| EP | 1553224 | A1 | 7/2005 |
| EP | 3192380 | A1 | 7/2017 |
| EP | 3223636 | B1 | 3/2020 |
| EP | 3658708 | A1 | 6/2020 |
| WO | 02077042 | A2 | 10/2002 |
| WO | 2010098514 | A1 | 9/2010 |
| WO | 2010122806 | A1 | 10/2010 |
| WO | 2018160584 | A1 | 9/2018 |
| WO | 2020089641 | A1 | 5/2020 |
| WO | 2021116881 | A1 | 6/2021 |
| WO | 2021116894 | A1 | 6/2021 |

OTHER PUBLICATIONS

Search Report dated Nov. 24, 2021, from corresponding Great Britain Patent No. GB2108044.5.

Search Report dated Jul. 28, 2021, from corresponding Great Britian Patent No. GB2101624.1.

International Search Report & Written Opinion dated May 24, 2022, from corresponding International Application No. PCT/EP2022/052411.

International Search Report & Written Opinion dated May 31, 2022, from corresponding International Application No. PCT/EP2022/052786.

Supplemental Search dated Sep. 28, 2025, from corresponding Chinese Application No. 202280010789.1.

Second Office Action dated Sep. 28, 2025, from corresponding Chinese Application No. 202280010789.1.

First Search dated Nov. 7, 2025, from corresponding Chinese Application No. 202280013338.3.

First Office Action with English translation dated Nov. 7, 2025, from corresponding Chinese Application No. 202280013338.3.

* cited by examiner

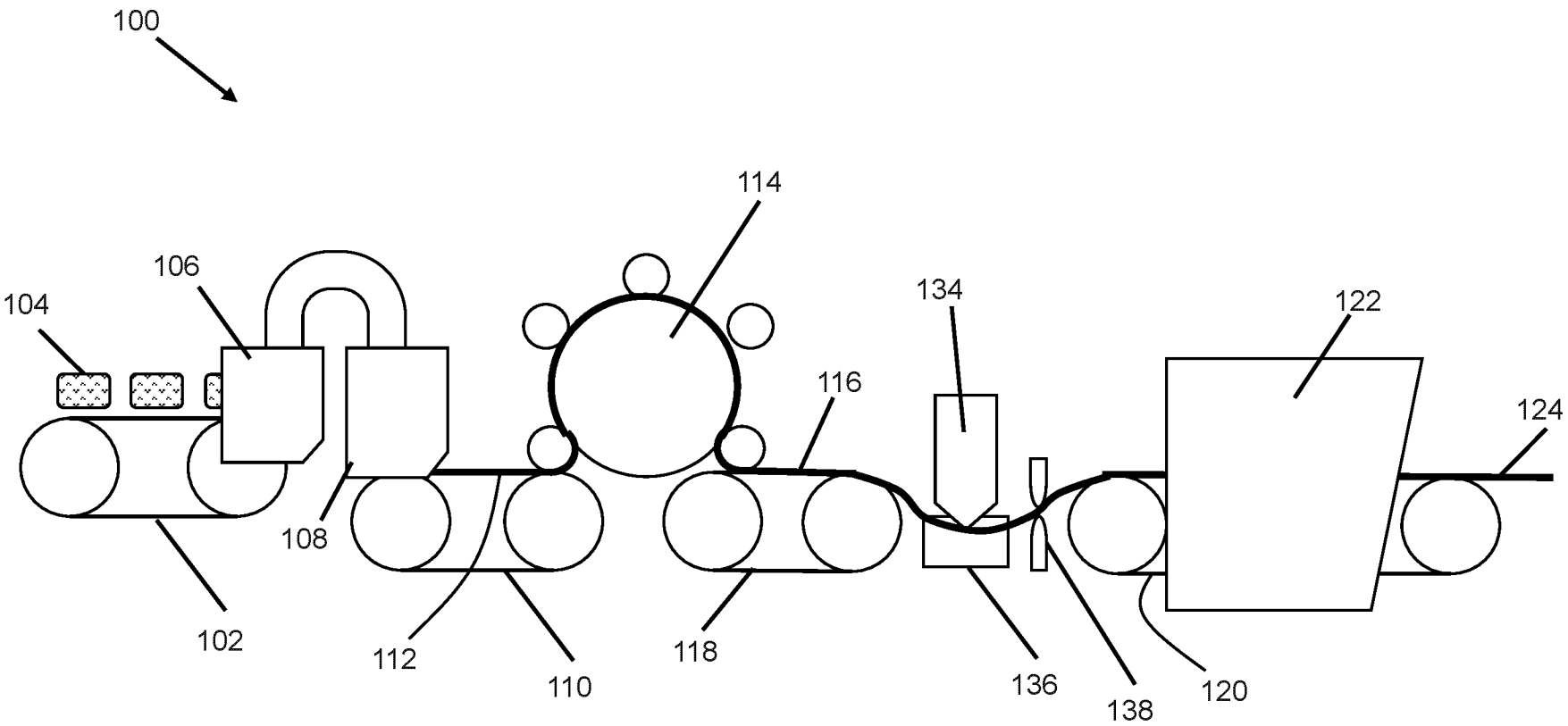
100
104
106
102
108
112
110
114
118
116
134
136
138
120
122
124

NONWOVEN FABRIC; POUCHED PRODUCT AND RELATED METHODS

CROSS-REFERENCE TO RELATED APPLICATIONS

The present application is a U.S. National Phase Application under 35 U.S.C. § 371 of International Patent Application No. PCT/EP2022/052786 filed Feb. 4, 2022, which claims priority to GB Application No. 2108044.5 filed Jun. 4, 2021, and GB Application No. 2101624.1 filed Feb. 5, 2021, the disclosure of which is herein incorporated by reference in its entirety.

FIELD OF THE INVENTION

The invention relates to a nonwoven fabric for use in manufacturing pouched products (for example oral pouched products), and such products. In particular, the invention relates to a nonwoven fabric with enhanced strength and stability to be suitable for use with modern oral products.

BACKGROUND

It is known to use nonwoven fabrics to manufacture a pouch for containing an individual portion of a product, such as smokeless tobacco (also known as "snus"), coffee, tea, etc., from which flavour is to be extracted. Examples of pouched products formed from a nonwoven fabric can be found in US 2014/0026912 A1 and US 2012/0103353 A1. Some such pouched products are intended to be used orally: they are known as oral pouched products.

Nonwoven fabrics have been used for many years to produce pouches for traditional smokeless tobacco product, such as snus. More recently, the market for this type of oral pouched product has expanded to encompass so-called "modern oral" products, in which the contents of the pouch can comprises a wide variety of materials, e.g. non-tobacco nicotine, flavourings, and/or other food-grade products.

Typically, the nonwoven fabrics used to produce pouched products are water-permeable, in order to permit substances (e.g. flavour) from the contents of the pouch to flow out.

Nonwoven fabric may be used to manufacture chewable pouches. For example, US 2018/0153211 A1 discloses a nonwoven fabric for manufacturing a pouched product, in which the pouch includes an elastic mesh of thermoplastic polyamide that ensures the pouch can endure repeated deformations caused by chewing. The elastic mesh in this example has a high percentage of open area (i.e. high porosity) to enable a rapid release rate of flavour from the pouch.

US 2013/0149254 A1 discloses a perforated chewable pouch made of a food grade material selected from silicone, latex, rubber or plastic. The pouch encloses a product that can be in a gel, semi-liquid, and/or liquid form. A user chews, sucks, and/or manipulates the pouch to cause the enclosed flavour product to leach out of the perforations into the user's mouth.

US 2014/0261480 A1 discloses a pouch formed from a fabric comprising melt-blown polymer fibres having a hydrophilic surface coating. The melt-blown material can be an elastomer (e.g. polymeric polyurethane) so that the pouch can tolerate being chewed.

Many other types of pouch and Epouched product are known in the art, whether for oral usage or otherwise.

It has long been recognised that biodegradable pouches are more environmentally sustainable. However, a difficulty in producing such pouches has been the degradation of them by the pouch contents; in particular, a reduction of the strength of bonding holding the pouch closed and a reduction of the integrity of the pouch material itself.

The present invention has been devised in the light of the above considerations.

SUMMARY OF THE INVENTION

In a first aspect, the present invention provides a nonwoven fabric for forming a pouched product, the nonwoven fabric comprising a chemically bonded web of staple fibres; wherein the web includes a non-fibrous binder with Hansen solubility parameters meeting the following requirements: $17.5 \leq \delta_d$ $(MPa^{0.5}) \leq 19.0$; $4.8 \leq \delta_p$ $(MPa^{0.5}) \leq 6.0$; $7.0 \leq \delta_h$ $(MPa^{0.5}) \leq 10.0$; and $R_0 \leq 5.0$.

The web may suitably be composed of a plurality of carded layers of the staple fibres.

In preferred embodiments, the non-fibrous binder comprises polybutylene succinate (PBS) or a polyurethane (PU). The non-fibrous binder may consist of PBS in some embodiments. The non-fibrous binder may consist of PU in some embodiments.

It may be suitable for the non-fibrous binder to be present in the nonwoven fabric in an amount greater than or equal to 30 wt % based on a dry weight of the nonwoven fabric, and/or suitably in an amount less than or equal to 50 wt % based on a dry weight of the nonwoven fabric.

The staple fibres are preferably present in the nonwoven fabric in an amount greater than or equal to 50 wt % based on a dry weight of the nonwoven fabric.

In some embodiments, the nonwoven fabric of the present invention has a fabric density greater than 140 g/mm; in some embodiments it has a fabric density less than or equal to 170 g/mm.

In a second aspect, the present invention provides a pouched product comprising a pouch formed from a nonwoven fabric comprising a chemically bonded web of staple fibres and a non-fibrous binder; wherein the pouch encloses a substance having at least one component; wherein the relative energy difference RED calculated in the Hansen space for the binder and said component is greater than 0.8.

Said component may in some embodiments be a liquid phase or a suspension.

It may be preferred for the relative energy difference RED calculated in the Hansen space for the non-fibrous binder and said component to be greater than 1.0.

Again, in preferred embodiments the non-fibrous binder comprises polybutylene succinate (PBS) or a polyurethane (PU). The non-fibrous binder may consist of PBS in some embodiments. The non-fibrous binder may consist of PU in some embodiments.

It may be suitable for the non-fibrous binder to be present in the nonwoven fabric in an amount greater than or equal to 30 wt % based on a dry weight of the nonwoven fabric, and/or suitably in an amount less than or equal to 50 wt % based on a dry weight of the nonwoven fabric.

The staple fibres are preferably present in the nonwoven fabric in an amount greater than or equal to 50 wt % based on a dry weight of the nonwoven fabric.

In the present invention (all aspects), the nonwoven fabric may suitably have a basis weight greater than 25 $g/m^2$.

In the pouched products of the present invention, said component may for example comprise at least one selected from water, glycerol, propylene glycol, d-limonene, methyl salicylate, L-menthol, menthone, carvone, cinnamaldehyde and vanillin, and preferably comprises methyl salicylate.

In a third aspect, the present invention provides a method for manufacturing a nonwoven fabric suitable for forming a pouched product, the method comprising: forming a consolidated web by combining a plurality of layers of staple fibres; and applying a non-fibrous binder to the consolidated web to bond the staple fibres together in a nonwoven fabric, wherein the non-fibrous binder has Hansen solubility parameters meeting the following requirements: $17.5 \leq 6_d (MPa^{0.5}) \leq 19.0$; $4.8 \leq \delta_p$ $(MPa^{0.5}) \leq 6.0$; $7.0 \leq \delta_h$ $(MPa^{0.5}) \leq 10.0$; and $R_0 \leq 5.0$.

In the methods of the present invention, the step of forming a consolidated web may in some embodiments comprise: discharging a dry loose fibre web of the staple fibres; and carding the loose fibre webs to form the each of the plurality of layers of staple fibres.

In the methods of the present invention, the step of applying the non-fibrous binder may in some embodiments comprise: impregnating the consolidated web with a non-fibrous binder solution; and drying the impregnated consolidated web to form the nonwoven fabric.

Again, in preferred embodiments the non-fibrous binder comprises polybutylene succinate (PBS) or a polyurethane (PU). The non-fibrous binder may consist of PBS in some embodiments. The non-fibrous binder may consist of PU in some embodiments.

The invention includes the combination of the aspects and preferred features described except where such a combination is clearly impermissible or expressly avoided.

SUMMARY OF THE FIGURES

Embodiments and experiments illustrating the principles of the invention will now be discussed with reference to the accompanying FIGURES in which:

FIG. 1 is a schematic drawing of apparatus for manufacture of a nonwoven fabric according to a method that is an embodiment of the invention.

DETAILED DESCRIPTION OF THE INVENTION

Aspects and embodiments of the present invention will now be discussed with reference to the accompanying FIGURES. Further aspects and embodiments will be apparent to those skilled in the art. All documents mentioned in this text are incorporated herein by reference.

A method of manufacturing a nonwoven fabric according to this example is now described with reference to FIG. 1. FIG. 1 is a schematic diagram showing an apparatus 100 for manufacturing a dry-laid carded nonwoven. However, it is to be understood that the invention need not be limited to this type of manufacturing technique.

In the apparatus 100 shown in FIG. 1, a first conveyor 102 transports fibre bales 104 to a bale opener 106, which separates and blends the fibres from each bale. The fibre bales 104 comprise staple fibres. Lyocell is used in the examples below, but other materials known in the art such as viscose are also suitable. In some examples the fibre bales 104 may contain multiple types of staple fibre, in particular multiple types of biodegradable fibres.

Lyocell is a form of regenerated cellulose, e.g. obtained by direct physical dissolution of wood pulp using a non-toxic solvent (e g amine oxide solution). Examples of lyocell fibre are commercially available from Lenzing AG under the trade name Tencel®. Lyocell can be manufactured in a sustainable manner using a substantially closed loop process in which the solvent and water used for dissolution are fully recycled. In this example, the staple fibres are 100% lyocell.

It will be recognised therefore that in some embodiments the staple fibres comprise lyocell, or consist of lyocell (100% lyocell). On the other hand, in some embodiments the staple fibres do not comprise lyocell (0% lyocell). For example, in some embodiments the staple fibres comprise viscose, or consist of viscose (100% viscose). The fibres may in some embodiments be $TiO_2$ free.

The staple fibres in the fibre bales 104 may have any suitable cross-section. In some examples, the staple fibres consist or comprise multilobal fibres, e.g. fibres exhibiting a cross-section comprises three or more lobes. Multilobal fibres may further assist in the transfer of micro-sized materials through the nonwoven fabric.

The bale opener 106 is connected to a feed hopper 108 that discharges the blended fibres as a loose fibre web 112 on a second conveyor 110. The loose fibre web 112 is conveyed to a carding machine 114 that combs the web to apply a desired orientation or plurality of orientations to the fibres in the web. The carding machine 114 thus outputs a consolidated web 116 on to a third conveyor 118.

In some examples the consolidated web 116 may comprise a plurality of carded layers. Each carded layer may be output from a respective carding machine 114 before being combined with the other carded layers into a single consolidated web. The plurality of carded layers may be obtained by divided the loose fibre web 112 between the respective carding machines. Providing a plurality of carded layers can improve the uniformity of the consolidated web.

The carding process may be optional. For example, the consolidated web 116 may be formed directly by air laying suitable fibres. In this example, the fibres may be crimped during manufacture to facilitate web formation in an air stream. Alternatively, the consolidated web 116 may be formed directly by a wet laying process.

The fibres in the consolidated web 116 may subsequently be bonded together by any conventional method. For example, a binder may be applied to the consolidated web, e.g. by conveying it using deflector 134 into a pan 136 filled with liquid binder or binder precursor (herein together also referred to as a binder solution), so that the binder impregnates or saturates the consolidated web 116. The consolidated web 116 is then transported to a fourth conveyor 120 via nip rollers 138, which operate to remove or squeeze excess liquid from the consolidated web 116. The web 116 is then carried through a dryer 122, which operates to dry the web and cure or stabilise the binder. In other examples, the binder may be applied by coating or spraying.

The binder may be applied as in an aqueous solution, where the water is subsequently removed by the drying process. However, other solvents may also be used.

It may be desirable for the binder or binder precursor to emit zero or a negligible amount of volatile organic compounds (VOCs).

In the fabrics and pouches of the present invention, a non-fibrous binder is present as explained below.

In particular, use of a non-fibrous binder distinguishes the present invention from previous disclosures where a fibrous binder is utilised. Suitably, a liquid binder containing substantially no fibres or fibrous structures is used.

Fibrous binders, such as fibrous polybutylene succinate (PBS fibres) may be included in the consolidated web as set out above, by being some proportion of the fibres making up that web. Then, for example by heating, the binder fibres act to bond the non-binder fibres together.

However, this bonding action using binder fibres leads to a cohesive 'thermal bonding' function—a point bonding. This is well understood in the art.

On the other hand, by utilising a non-fibrous binder in the present invention (for example one applied as a binder solution as explained herein—effectively, a liquid binder), an adhesive 'chemical bonding' function is obtained—a much stronger bonding coating. This means there is a structural difference between bonded webs where, for example, fibrous PBS and non-fibrous PBS are used as the binder.

Chemical bonding may be preferred; for example, it can give a more uniform 3D structure.

[It is noted here that, while fibrous PBS is mentioned above, to the inventor's knowledge no 100% PBS fibre is commercially available; generally what is referred to as a PBS fibre is in fact a bicomponent system with another polymer such as polylactic acid. In such systems, the PLA forms a core and PBS forms a sheath.]

[It is further noted that, where PBS is used as the binder, 'fibrous PBS' is defined as a single use plastic by EU directive. On the other hand, non-fibrous PBS is not.]

In some examples, the final nonwoven fabric is biodegradable. In such cases, the binder is biodegradable or biotransformable.

Herein, 'biodegradable' may refer to materials which biodegrade under aerobic conditions under testing conditions as set out in ISO 14855-1 (2012), or DIN EN 13432, or ASTM D 6400-04. Preferably, over 75% absolute biodegradation occurs after 45 days of testing at 58° C.±2° C.

Other additives may be added to the consolidated web. For example, a triglyceride additive may be used to further improve the wet strength of the resulting fabric.

The process is configured such that a resulting bonded web 124 has a basis weight greater than 25 g/m$^2$, e.g. up to 35 g/m$^2$ or even 40 g/m$^2$. Nonwoven fabrics having a lower basis weight may provide structures that are too open for the type of substance used in many modern oral products. For example, many non-tobacco modern oral product may comprise materials with fine particles (e.g. having dimension less than or of the order of a micron) that may more readily pass a fabric network than more conventional macro-sized substances. The basis weight is typically achieved by selection of the relative proportion of binder to fibre matrix, and by controlling the rate at which the fibre web is laid on the conveyor. For example, the binder may provide up to 50 wt % of the resulting bonded web 124. The binder may be present in the final nonwoven fabric in a range between 30 to 50 wt %, based on the dry weight of the nonwoven fabric.

In certain embodiments of the present invention, the nonwoven fabric has a basis weight in the range 27 g/m$^2$ to 31 g/m$^2$. It may suitably be 29 g/m$^{2\pm10}$%.

The basis weight of the resulting bonded web 124 may be selected in conjunction with a thickness of the web to provide the material with a desired fabric density. Fabric density may affect the material's air and liquid permeability. Air permeability may be important if the fabric is subsequently used in a pouching process, e.g. to form an enclosure for a substance for oral delivery. Such processes typically involve heat sealing the fabric with itself to form the pouch enclosure, after a substance to be pouched has been positioned on the fabric; or alternatively an open pouch may be formed, the substance filled into it, and then the pouch closed by heat sealing.

Liquid permeability may be important for the ability of the fabric to release substances into a user's mouth. Fabric density also has an impact on the strength of the fabric. The inventors have found that selecting a fabric density in the range 140 g/mm to 170 g/mm, and preferably in the range 150 g/mm to 160 g/mm, can provide an optimal balance of these factors.

Fabric thickness is also a property affecting permeability (both liquid and air), as well as mouth feel by way of an effect on flexibility. The inventors have found that selecting a fabric thickness in the range 0.15 mm to 0.25 mm, and preferably in the range 0.17 mm to 0.23 mm, can be suitable.

The present inventors have found that the selection of binder used is vital to obtaining enhanced properties of the nonwoven fabric and pouched product. In particular, they have found that in a heat sealed pouched product the integrity of the heat seal may be affected by interaction of the contents of the pouched product with the binder. They have also found that interaction of the contents of the pouched product with the binder may affect the integrity of the fabric itself. [It will be understood that each of these is a fibre-binder-fibre connection.]

The inventors have found that Hansen Solubility Parameters of the binder, and the intended contents of the pouched product are an effective predictor of such interactions. They have identified certain parameters, and binders, which are therefore advantageous to use. Contact between certain contents of the pouched product and a fabric comprising certain binders can lead to degradation of the binder and hence damage to the fabric. Accordingly, understanding the Hansen Solubility Parameters of the components of the substance to be contained in the pouched product, the individual ingredients as well as the combined Hansen Solubility Parameters of for example a liquid phase or suspension, or the substance as a whole, which might interact with the binder, is important.

The substance to be contained in the pouched product may contain one or more solvents, humectants, buffers, colourants or flavourings, in addition to other ingredients.

Common solvents include water, glycerol and propylene glycol. In some embodiments the substance comprises one or more of these.

Common flavourings include d-Limonene, methyl salicylate (wintergreen), L-menthol (peppermint), menthone (also peppermint), carvone (spearmint), cinnamaldehyde, vanillin, ascorbic acid (Vitamin C), mint, glycyrrhizic acid (liquorice), coffee and the like. In some embodiments the substance comprises one or more of these.

A preferred flavouring is methyl salicylate; accordingly the substance contained in the present pouched product may preferably comprise methyl salicylate.

Common humectants include glycerol, propylene glycol, alginate, modified starch, hydroxypropyl cellulose, triacetin, polyethylene glycol (PEG), pectin, and xanthan gum. In some embodiments the substance comprises one or more of these.

Common buffers include carbonates, bicarbonates, borates, glycinates, ammonium, phosphates, hydroxides, tris, sorbates and so on. In particular sodium carbonate, sodium bicarbonate, potassium carbonate, potassium sorbate and the like can be mentioned. In some embodiments the substance comprises one or more of these.

The substance to be contained in the pouched product may include additionally an active ingredient, such as nicotine or a nicotine salt, tobacco, cannabidiol or caffeine.

The pouched product itself may in some embodiments be an oral pouched product, that is, one intended to be placed in the mouth of a user.

The substance contained in a pouched product is usually not entirely dry; if may have a moisture (water) content of, for example, 15 to 55 wt %. It will be recognised that in the field of oral pouched products, often a moisture content of around 20% is classified as a "dry fill" and a moisture content of around 45-50 wt % is classified as a "wet fill".

When the moisture content of the substance contained in the pouched product is higher, potentially degrading ingredients are more likely to move (and more easily moved) 'through' the substance, allowing easier contact with the fabric of the pouch. Accordingly the present invention may be particularly applicable to pouches where the substance contained has a moisture content of 15 wt % or more, preferably 30 wt % or more, and more preferably 40 wt % or more. However it is still applicable where the moisture content is outside that range.

Hansen Solubility Parameters

Hansen Solubility Parameters are well known and understood, having first been developed in 1967. In this solubility system, molecules are given three parameters, each with units $MPa^{0.5}$.

$\delta_d$ the energy from dispersion forces between molecules.

$\delta_p$ the energy from dipolar intermolecular force between molecules.

$\delta_h$ the energy from hydrogen bonds between molecules.

These parameters act effectively as 'co-ordinates' for the molecules within a Hansen space. In general, a single molecule has a single set of parameters, coordinates and is hence described as a point in the Hansen space. However some molecules, in particular polymers, have a much more complex set of interaction and are hence assigned a 'radius' within the Hansen space ($R_0$, the interaction radius; units $MPa^{0.5}$).

The Hansen parameters are related by addition of squares to the square of the Hildebrand solubility parameter (standard, another well known solubility measurement; units $MPa^{0.5}$).

$$\delta_t^2=\delta_d^2+\delta_p^2+\delta_h^2$$

Some reference values for these parameters include:

| | $\delta_d$ ($MPa^{0.5}$) | $\delta_p$ ($MPa^{0.5}$) | $\delta_h$ ($MPa^{0.5}$) | $\delta_t$ (calculated) ($MPa^{0.5}$) | $R_0$ ($MPa^{0.5}$) |
|---|---|---|---|---|---|
| Polybutylene succinate (PBS) | 18.63 | 5.55 | 7.99 | 21.017 | 3.8 |
| Polyurethane* | 18.10 | 4.90 | 9.80 | 21.158 | 4.4 |
| Polylactic acid (PLA) | 18.60 | 9.90 | 6.00 | 21.908 | 10.7 |
| Vinyl acetate copolymer | 19.45 | 10.59 | 5.76 | 22.883 | 14 |
| Methyl salicylate | 18.10 | 8.00 | 13.90 | 24.183 | — |
| Water | 15.5 | 16 | 42.3 | 47.81 | — |
| Glycerol | 17.40 | 12.10 | 29.30 | 36.162 | — |
| Propylene glycol | 16.80 | 9.40 | 23.30 | 30.224 | — |
| Vitamin C (ascorbic acid) | 18.00 | 11.70 | 25.50 | 31.213 | — |
| Ethanol | 15.8 | 8.8 | 19.4 | 26.52 | — |
| L-Menthol | 16.0 | 4.7 | 9.0 | 18.95 | — |
| Acetic acid | 14.5 | 8.0 | 13.5 | 21.37 | — |
| Trans-Cinnamaldehyde | 19.4 | 12.4 | 6.2 | 23.84 | — |

-continued

| | $\delta_d$ ($MPa^{0.5}$) | $\delta_p$ ($MPa^{0.5}$) | $\delta_h$ ($MPa^{0.5}$) | $\delta_t$ (calculated) ($MPa^{0.5}$) | $R_0$ ($MPa^{0.5}$) |
|---|---|---|---|---|---|
| d-Limonene | 17.2 | 1.8 | 4.3 | 17.82 | — |
| Menthone | 17.0 | 8.1 | 4.4 | 19.34 | — |
| Carvone | 18.0 | 5.6 | 6.4 | 19.91 | — |
| Vanillin | 18.6 | 10.6 | 13.8 | 25.47 | — |

*These values are estimated for a polyurethane comprising polymer chains formed from adipate polyester polyol, aliphatic hexamethylene diisocyanate, isophorone diisocyanate and 4,4'-methylenedi(cyclohexyl isocyanate) monomers; with a number average molecular weight of the polymer being 150-300 g/mol.

Hansen solubility parameters and $R_0$ can be determined experimentally using procedures which are known in the art.

The present inventors have found that, in some embodiments, use of a binder with a Hildebrand solubility parameter ($\delta_t$) in the range of 20.8 to 21.2 may be advantageous in providing a fabric which is resistant to degradation, dissolution or other effects caused by the intended contents of a pouched product.

The inventors have also found that, in some embodiments, use of a binder with Hansen solubility parameters meeting the following requirements may be advantageous: $17.5\leq\delta_d\leq19.0$; $4.8\leq\delta_p\leq6.0$ (preferably $5.0\leq\delta_p\leq6.0$); and $7.0\leq\delta_h\leq10.0$ (preferably $7.0\leq\delta_h\leq8.5$).

The inventors have also found that having a suitable $R_0$ value assist with these advantages. Accordingly, in some embodiments the binder has an $R_0$ value of less than or equal to 5.0, preferably less than or equal to 4.5, most preferably less than or equal to 4.0.

It will be recognised that the binder may preferably meet one, two or all three of the conditions mentioned above for (i) $\delta_t$; (ii) $\delta_d$, $\delta_p$ and $\delta_h$; and (iii) $R_0$.

In the present invention, the non-fibrous binder preferably comprises non-fibrous polybutylene succinate, PBS, or a non-fibrous polyurethane, PU. In some embodiments the non-fibrous binder consists of non-fibrous polybutylene succinate. In some embodiments the non-fibrous binder consists of non-fibrous polyurethane. It will be apparent that in some embodiments "the binder" in the present invention will comprise multiple components, for example two or more chemical compounds. In such a case, the solubility properties of the (mixed) binder can be calculated as set out below.

As described herein, a polyurethane (PU) binder may suitably be used. Suitable polyurethane binders may comprise polymer chains formed from adipate polyester polyol, aliphatic hexamethylene diisocyanate, isophorone diisocyanate and 4,4'-methylenedi(cyclohexyl isocyanate) monomers (that is, a polyurethane obtainable by reaction of adipate polyester polyol, aliphatic hexamethylene diisocyanate, isophorone diisocyanate and 4,4'-methylenedi(cyclohexyl isocyanate) monomers); with a number average molecular weight of the polymer being 150-300 g/mol.

Suitable polyurethane binders may additionally have a viscosity (23° C., spindle L2/30 rpm, DIN EN ISO 2555) of less than about 200 cP, for example less than about 150 cP. Suitable polyurethane binders may additionally or alternatively have a pH of 6.0-9.0 (DIN ISO 976).

Particularly suitable polyurethane binders include those available as ST6515 from Scitech adhesives and coatings, Flint, UK; or Dispercoll® U 2682 from Covestro, Leverkusen, Germany.

Where 'polyurethane' or 'PU' is mentioned herein, it may be understood that in some embodiments the above described suitable polyurethane binders are intended. That is, all disclosures herein relating to 'polyurethane' can be taken as being made relating to the suitable polyurethane binders, having one or more of the properties described for suitable polyurethane binders, discussed above as well.

When applied as a binder solution (liquid binder), the non-fibrous PBS or PU may preferably be in the form of an emulsion. Suitably it does not contain any fibre of fibrous structures.

When PBS is applied as a binder solution, that solution may have non-fibrous PBS as a major (>50 wt %) non-aqueous component. The solution may comprise a binder element dispersed/emulsified in water. The binder element may suitably make up about 20-60 wt % of the solution, preferably about 30-50 wt %, and more preferably about 40 wt %. Within the binder element, non-fibrous PBS may preferably be the main (>50 wt %, preferably >75 wt %, more preferably >90 wt %) component. The balance may comprise, for example, one or more of a stabilizer such as polyvinyl alcohol (PVOH)(the stabilizer being 0-8 wt % of the binder element), a cross linker such as adipic acid (the cross linker being 0-4 wt % of the binder element), a thickener such as xantham gum (the thickener being 0-2 wt % of the binder element), and a preservative such as benzoic acid (the preservative being 0-2 wt % of the binder element). In some embodiments the binder element may be solids.

When PU is applied as a binder solution, that solution may have non-fibrous PU as a major (>50 wt %) non-aqueous component. The solution may comprise a binder element dispersed/emulsified in water. The binder element may suitably make up about 30-70 wt % of the solution, preferably about 40-60 wt %, and more preferably about 50 wt %. Within the binder element, non-fibrous PU may preferably be the main (>50 wt %, preferably >75 wt %, more preferably >90 wt %) component. The balance may comprise, for example, one or more of a solvating agent such as acetone/propan-2-one (the solvating agent being 0-2 wt % of the binder element), a thickener or emulsifier such as stearyl alcohol (the thickener or emulsifier being 0-1 wt % of the binder element), and a biocide (the biocide being 0-0.5 wt % of the binder element). In some embodiments the binder element may be solids.

Distance Between Hansen Parameters

Within the three dimensional Hansen space, a distance or spacing Ra (units $MPa^{0.5}$) between spheres (when an $R_0$ is present) or points can be calculated using the following formula:

$$Ra^2=4(\delta_{d2}-\delta_{d1})^2+(\delta_{p2}-\delta_{p1})+(\delta_{h2}-\delta_{h1})^2$$

Wherein $\delta_{d1}$, $\delta_{p1}$ and $\delta_{h1}$ are the Hansen solubility parameters for a first material, e.g a polymer (in the present invention, for example, a binder) and $\delta_{d2}$, $\delta_{p2}$ and $\delta_{h2}$ are the Hansen solubility parameters for a second material, e.g a component of the substance filled into a pouched product made from a fabric comprising a binder (for example, the one or mixture of plural solvents and flavourings comprised in that substance).

The present inventors have found this a useful way of determining which binders may be most suitable for use with certain contents of a pouched product. The substance contained within the pouch (which might theoretically be any substance) almost always contains one or more ingredients which, alone or together, might have some unfavourable interaction with certain binders.

The present inventors have found that by control of the distance Ra between the non-fibrous binder material and at least one of the components of the substance contained in the pouched product, the interaction of that component and non-fibrous binder can be limited and hence the integrity of the fabric and pouch increased. It will be apparent that the more components (for example, by volume) for which this is true the better. Similarly, where certain ingredients mix to form a single e.g. liquid phase, a similar distance Ra consideration can apply to the non-fibrous binder and that phase. It may be that 'overall' Hansen Solubility Parameters can be calculated for the substance as a whole; again, it will be apparent that the same preference for certain Ra may apply.

That is, the "component" of the substance for which the Ra is calculated may in some embodiments be a single ingredient of the substance contained in the pouch; in some embodiments it may be a single phase (e.g. a liquid phase) of the substance contained in the pouch; in some embodiments it may be a suspension comprised in the substance contained in the pouch. In some embodiments it may even be the whole of the substance contained in the pouch.

In some embodiments, then, that distance Ra is $4.0 \leq Ra$, preferably $5.0 \leq Ra$ and most preferably $6.0 \leq Ra$. In some embodiments the distance Ra is $Ra \leq 10.0$, preferably $Ra \leq 7.5$ and most preferably $Ra \leq 6.5$.

Relative Energy Difference (Red)

From these solubility considerations, the present inventors theorise that dissolution of the non-fibrous binder and component(s) of the substance contained in the pouched product may be a contributing factor to loss of fabric or pouch integrity. Accordingly the relative energy difference (RED; no units) between the non-fibrous binder and component(s) of that substance can be considered as a guide to whether or not an integrity affecting interaction will occur.

RED is calculated as $RED=Ra/R_0$. It is generally understood that RED<1 means the system will dissolve; RED=1 means the system will partially dissolve; and RED>1 means the system will not dissolve.

It is therefore preferred that the non-fibrous binder is selected such that RED>1 for at least one component of the substance, preferably all such components, to avoid a solubility interaction which can lead to loss of fabric or seal integrity. However, the present inventors have found that even where RED>0.8 an advantageous increase of fabric and pouch integrity as compared to standard pouches can be achieved. In most preferred embodiments, the non-fibrous binder is selected such that $RED \geq 1.1$, more preferably $RED \geq 1.3$, more preferably $RED \geq 1.6$.

It will be recognised that an advantage can be achieved by the above defined solubility properties of the non-fibrous binder itself and or also relative to any one component of the substance within the pouch. That is, it is not necessary that the above conditions are met for every component of the substance contained within the pouch; advantage can be achieved by reducing negative effects associated with just one such component interacting with the non-fibrous binder. Of course, in preferred embodiments the conditions described herein are met for the non-fibrous binder in comparison to multiple components contained within the pouched substance (where multiple are present); most preferably in comparison to all such components that are present. It may be that the solubility properties discussed herein are met for component(s) making up at least 20 vol % of the substance contained in the pouch, for example at least 40 vol %, or at least 60 vol %, or at least 80 vol %.

Where multiple ingredients are present, in the substance as a whole or within a mixed component such as a liquid phase, the Hansen solubility parameters of that mixture may be used to assess and make a comparison with the non-fibrous binder for the mixture as a whole.

Ingredients of the pouched substance in the solid phase may be of less importance when assessing the effect on the non-fibrous binder; often they are present in relatively low quantity and/or are not very 'mobile' within the pouch and so may not have a significant solubilising effect. Accordingly in some embodiments it may be preferably for the solid components to be ignored in the calculations.

The skilled reader will also understand that where multiple ingredients are present in a component such as a liquid phase or in the substance as a whole (in particular multiple solvents and/or multiple flavourings), or as multiple ingredients of the non-fibrous binder, effective Hansen solubility parameters can be calculated for the mixture. This is done on a pro rated scale (Hansen solubility parameters of the mix are the volume-weighted averages of the Hansen solubility parameters of the components). For example in a two component mixture:

$\delta_d^{mix}$=[($\delta d^{component1}$*volume content of component 1 as a fraction of total volume)+(($\delta_d^{component2}$*volume content of component 2 as a fraction of total volume)]/2.

$\delta_p^{mix}$=[($\delta_p^{component1}$*volume content of component 1 as a fraction of total volume)+(($\delta_p^{component2}$*volume content of component 2 as a fraction of total volume)]/2.

$\delta_h^{mix}$=[($\delta_h^{component1}$*volume content of component 1 as a fraction of total volume)+($\delta_h^{component2}$*volume content of component 2 as a fraction of total volume)]/2.

Table 1 summarises a desirable composition and properties of a nonwoven fabric that is an embodiment of the invention.

TABLE 1

Fabric composition and properties

| Property | Desirable characteristic |
|---|---|
| Composition | 50-70 wt % staple fibre<br>30-50 wt % binder<br>0-5 wt % additives |
| Basis weight | 25-35 g/m$^2$ |
| Fabric thickness | 0.15-0.25 mm |
| Fabric density | 140-170 g/mm |
| Wet strength | 25-30 N/50 mm |
| Surface roughness | RZ < 70 μm<br>RC > 50 μm |
| Air permeability | >1700 l/m$^2$/s |
| Heat sealability | >1000 g |

A given material sample may be tested for the above properties using conventional techniques. For example, the basis weight test results can be obtained using the NWSP130.1.R0 EDANA test method. The thickness of a fabric can be obtained using the NWSP120.6.R0 EDANA test method, whereupon fabric density can be measured by dividing fabric weight by fabric thickness.

Surface roughness may provide a measurable parameter that is indicative of mouthfeel. It can be measured using an industry standard surface roughness tester machine, e.g. SurfTest SJ-210. Wet strength can be measured using the 20.2-89 EDANA test method. The air permeability can be obtained using the 070.1.R3 (12) EDANA test method.

The final property relates to a test for whether the fabric is capable of forming a pouch having the required sealing strength for use in an oral pouched product. These test results can be obtained using the CORESTA Recommended Method No. 90 on a heat-sealed pouch formed from the relevant fabric.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the word "comprise" and "include", and variations such as "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means for example +/−10%.

EXAMPLES

To demonstrate the effects of the present invention, two examples and two comparative examples were prepared.

All examples have been assessed for a range of physical properties: weight, tenacity (wet & dry), elongation and heat seal (as produced and post exposure to flavour).

Heat sealing of prepared fabric samples and heat seal strength is determined by a standard heat seal strength measurement procedure. The method is used to evaluate fabric sample heat seal strength, of which samples exposed to a strong flavour (in these examples Methyl Salicylate, a common ingredient in the substances contained in pouched products) are compared to equivalent samples not exposed to flavour. These tests accordingly provide some assessment of the resistance of the fabric to that ingredient.

Preparation of samples exposed to flavour is carried out by immersing the heat sealed fabric within the flavour for approximately five minutes and then air dry for 24 hours, prior to heat seal strength testing.

Example 1

A polybutylene succinate solution was applied by mangle application, at a level of 43% by weight of final fabric weight, to a carded $TiO_2$ free viscose fibre base which was 57% by weight of final fabric weight. The fabric was then dried and cured at 120° C. Final fabric weight was 30.0 gsm. The thus produced chemically bonded web fabric was then heat sealed and assessed for flavour resistance by heat seal strength measurement.

Example 2

A polybutylene succinate solution was applied by mangle application, at a level of 43% by weight of final fabric weight, to a carded $TiO_2$ free Lyocell fibre base which was 57% by weight of final fabric weight. The fabric was then dried and cured at 120° C. Final fabric weight was 31.0 gsm. The thus produced chemically bonded web fabric was then heat sealed and assessed for flavour resistance by heat seal strength measurement.

Comparative Example 1

A polylactic acid solution was applied by mangle application, at a level of 43% by weight of final fabric weight, to a carded $TiO_2$ free Lyocell fibre base which was 57% by weight of final fabric weight. The fabric was then dried and cured at 120° C. Final fabric weight was 29.7 gsm. The thus produced chemically bonded web is then heat sealed and assessed for flavour resistance by heat seal strength measurement.

Comparative Example 2

As a control, a "standard" chembonded fabric product was used (Vinyl Acetate CoPolymer binder solution applied by mangle application, at a level of 43% by weight of final fabric weight, to a carded Viscose fibre base which was 57% by weight of final fabric weight; final fabric weight was 30 gsm).

| | Weight g/m$^2$ | Fibre/ binder ratio | Thickness mm | Dry tensile strength (No Methyl Salicylate exposure) MD N/50 mm | Dry Extension (No Methyl Salicylate exposure) MD % | Wet Tensile strength (No Methyl Salicylate exposure) MD N/50 mm | Wet Tensile strength (No Methyl Salicylate exposure) TD N/50 mm | Heat seal strength measurement (No Methyl Salicylate exposure) Dry N/mm |
|---|---|---|---|---|---|---|---|---|
| Comparative Example 2 | 30.0 | 57/43 | 0.19 | 60.5 | 11.6 | 22.6 | 3.9 | 0.131 |
| Example 1 | 30.0 | 57/43 | 0.21 | 63.3 | 7.1 | 21.3 | 4 | 0.358 |
| Example 2 | 31.0 | 57/43 | 0.21 | 66.0 | 7.2 | 20.5 | 4.7 | 0.488 |
| Comparative Example 1 | 29.7 | 57/43 | 0.24 | 91.6 | 7.9 | 27.3 | 3.7 | 0.248 |

| | Air Permeability L/m$^2$/s | Bend length cm | Dry Elongation (No Methyl Salicylate exposure) % | Tensile strength MD (Methyl Salicylate exposure) N/50 mm | Elongation (Methyl Salicylate exposure) MD % | Heat seal strength measurement (Methyl Salicylate exposure) N/mm |
|---|---|---|---|---|---|---|
| Comparative Example 2 | 4108 | 5 | 10 | 10 | 22 | 0.0001 |
| Example 1 | 5139 | 7.5 | 8 | 54 | 12 | 0.195 |
| Example 2 | 4866 | 7.4 | 11 | 58 | 8 | 0.193 |
| Comparative Example 1 | 4699 | 8.0 | 15 | 8 | 20 | 0.002 |

For easier comparison:

| | Dry tensile strength (No Methyl Salicylate exposure) MD N/50 mm | Tensile strength MD (Methyl Salicylate exposure) N/50 mm | Heat seal strength measurement (No Methyl Salicylate exposure) Dry N/mm | Heat seal strength measurement (Methyl Salicylate exposure) N/mm |
|---|---|---|---|---|
| Example 1 | 63.3 | 54 | 0.358 | 0.195 |
| Example 2 | 66.0 | 58 | 0.488 | 0.193 |
| Comparative Example 1 | 91.6 | 8 | 0.248 | 0.002 |
| Comparative Example 2 | 60.5 | 10 | 0.131 | 0.0001 |

These data show that the Transducer heat seal decreases for all the samples post exposure to methyl salicylate. However, the decrease is significantly lower (that is, the heat seal is significantly more resistant to the flavour) for Examples 1 and 2 (45.5% reduction and 60.5% reduction respectively) than for Comparative Examples 1 and 2 (99.2% reduction and 100% reduction respectively).

Further, these data show that fabric tensile strength (MD) decreases for all the samples post exposure to methyl salicylate. However, the decrease is significantly lower (that is, the fabric is significantly more resistant to the flavour) for Examples 1 and 2 (14.7% reduction and 12% reduction respectively) than for Comparative Examples 1 and 2 (91.2% reduction and 83.5% reduction respectively).

It is therefore apparent that Examples 1 and 2 showed significantly improved flavour resistance.

| | Binder | Ingredient | Ra ($MPa^{0.5}$) | $R_0$ of binder ($MPa^{0.5}$) | RED |
|---|---|---|---|---|---|
| Example 1 | Polybutylene succinate | Methyl salicylate | 6.485 | 3.8 | 1.707 |
| Example 2 | Polybutylene succinate | Methyl salicylate | 6.485 | 3.8 | 1.707 |
| Comparative Example 1 | Polylactic acid | Methyl salicylate | 8.187 | 10.7 | 0.765 |
| Comparative Example 2 | Vinyl acetate copolymer | Methyl salicylate | 8.959 | 14 | 0.640 |

The invention claimed is:

1. A nonwoven fabric for forming a pouched product, the nonwoven fabric comprising a chemically bonded web of staple fibres;

wherein the web includes a non-fibrous binder with Hansen solubility parameters meeting the following requirements: $17.5 \leq \delta_d (MPa^{0.5}) \leq 19.0$; $4.8 \leq \delta_p (MPa^{0.5}) \leq 6.0$; $7.0 \leq \delta^h (MPa^{0.5}) \leq 10.0$; and $R_0 \leq 5.0$.

2. The nonwoven fabric according to claim 1, wherein the web is composed of a plurality of carded layers of the staple fibres.

3. The nonwoven fabric according to claim 1, wherein the non-fibrous binder comprises polybutylene succinate (PBS) or a polyurethane (PU).

4. The nonwoven fabric according to claim 1, wherein the non-fibrous binder is present in the nonwoven fabric in an amount greater than or equal to 30 wt % based on a dry weight of the nonwoven fabric.

5. The nonwoven fabric according to claim 1, wherein the non-fibrous binder is present in the nonwoven fabric in an amount less than or equal to 50 wt % based on a dry weight of the nonwoven fabric.

6. The nonwoven fabric according to claim 1, wherein the staple fibres are present in the nonwoven fabric in an amount greater than or equal to 50 wt % based on a dry weight of the nonwoven fabric.

7. The nonwoven fabric according to claim 1, wherein the fabric density is greater than 140 g/mm.

8. The nonwoven fabric of claim 7, wherein the fabric density is less than or equal to 170 g/mm.

9. A pouched product comprising a pouch formed from a nonwoven fabric comprising a chemically bonded web of staple fibres and a non-fibrous binder; wherein the pouch encloses a substance having at least one component;

wherein the relative energy difference RED calculated in the Hansen space for the non-fibrous binder and said component is greater than 0.8.

10. The pouched product according to claim 9, wherein said component is a liquid phase or a suspension.

11. The pouched product according to claim 9, wherein the relative energy difference RED calculated in the Hansen space for the non-fibrous binder and said component is greater than 1.0.

12. The pouched product according to claim 9, wherein the non-fibrous binder comprises polybutylene succinate (PBS) or a polyurethane (PU).

13. The pouched product according to claim 9, wherein the non-fibrous binder is present in the nonwoven fabric in an amount greater than or equal to 30 wt % based on a dry weight of the nonwoven fabric.

14. The pouched product according to claim 9, wherein the non-fibrous binder is present in the nonwoven fabric in an amount less than or equal to 50 wt % based on a dry weight of the nonwoven fabric.

15. The pouched product according to claim 9, wherein the staple fibres are present in the nonwoven fabric in an amount greater than or equal to 50 wt % based on a dry weight of the nonwoven fabric.

16. The pouched product according to claim 9, wherein the nonwoven fabric has a basis weight greater than 25 $g/m^2$.

17. The pouched product according to claim 9, wherein said component comprises at least one selected from water, glycerol, propylene glycol, d-limonene, methyl salicylate, L-menthol, menthone, carvone, cinnamaldehyde and vanillin, and preferably comprises methyl salicylate.

18. A method for manufacturing a nonwoven fabric suitable for forming a pouched product, the method comprising:

forming a consolidated web by combining a plurality of layers of staple fibres; and applying a non-fibrous binder to the consolidated web to bond the staple fibres together in a nonwoven fabric, wherein the non-fibrous binder has Hansen solubility parameters meeting the following requirements: $17.5 \leq \delta_d (MPa^{0.5}) \leq 19.0$; $4.8 \leq \delta_p (MPa^{0.5}) \leq 6.0$; $7.0 \leq \delta_h (MPa^{0.5}) \leq 10.0$; and $R_0 \leq 5.0$.

19. The method of claim 18, wherein the step of forming a consolidated web comprises:

discharging a dry loose fibre web of the staple fibres; and carding the loose fibre webs to form the each of the plurality of layers of staple fibres.

20. The method of claim 18, wherein the step of applying the non-fibrous binder comprises:

impregnating the consolidated web with a non-fibrous binder solution; and drying the impregnated consolidated web to form the nonwoven fabric.

21. The method of claim 18, wherein the non-fibrous binder comprises polybutylene succinate (PBS) or a polyurethane (PU).

* * * * *